United States Patent [19]

Cochrane

[11] Patent Number: 4,840,005

[45] Date of Patent: Jun. 20, 1989

[54] PURLIN BRIDGING

[75] Inventor: Ronald Cochrane, Queensland, Australia

[73] Assignee: Australian Building Industries Pty. Ltd., Queensland, Australia

[21] Appl. No.: 228,032

[22] Filed: Aug. 4, 1988

[30] Foreign Application Priority Data

Jun. 1, 1988 [AU] Australia ..... 16953/88

[51] Int. Cl.[4] ..... E04C 2/42; E04C 3/02

[52] U.S. Cl. ..... 52/667; 52/696; 52/714

[58] Field of Search ..... 52/695, 696, 712, 667; 403/347, 374, 252

[56] References Cited

U.S. PATENT DOCUMENTS

| | | | |
|---|---|---|---|
| 3,503,641 | 3/1970 | Fraser | 52/667 |
| 3,731,583 | 5/1973 | Jureit | 52/712 |
| 3,778,952 | 12/1973 | Soucy | 52/696 |
| 4,151,694 | 5/1979 | Sriberg | 52/667 |
| 4,640,077 | 2/1987 | Hall | 403/347 |

*Primary Examiner*—John E. Murtagh

*Attorney, Agent, or Firm*—Foley & Lardner, Schwartz, Jeffery, Schwaab, Mack, Blumenthal & Evans

[57] ABSTRACT

Purlin bridging for building frames has bridging members, each with a web-tempered channel provided with hooks at one end and lugs at the other end. The lugs extend perpendicularly to the web for engagement in the holes in the purlins and are locked therein by the hooks of the next succeeding bridging member. The lugs may be provided with slots to receive and engage the hooks.

5 Claims, 2 Drawing Sheets

PURLIN BRIDGING

BACKGROUND OF THE INVENTION (1) Field of the Invention

This invention relates to purlin bridging.

(2) Prior Art

Rolled steel purlins commonly used in the framing of buildings usually require to be bridged at intervals to maintain their parallelism and prevent twisting. A well known purlin is rolled to the form of a vertical web with oppositely directed flanges extending from top and bottom, the distal portion of the upper flange being down-turned, that of the bottom flange being up-turned. The web is usually formed at intervals with pairs of holes, and holes aligned with these are formed in the top and bottom flanges also, these holes being provided to enable the bolting to the purlins of other structural members of the building, including the connection of bridging members between succeeding purlins.

The bridging members hitherto used are normally channel sections with connector fittings attached to their ends, and they have the disadvantages of being costly to manufacture and inconvenient and laborious to connect to the purlins and, unless they are formed of heavy gauge sheet metal, they are likely to fail under stress. Furthermore, they are bulky to store and transport.

SUMMARY OF THE PRESENT INVENTION

The present invention has been devised with the general object of providing purlin bridging members which may be made simply and economically and quickly and easily applied to the bridging of purlins. They may also be capable of being readily interfitted or nested for convenience in storage and transport.

BRIEF DESCRIPTION OF THE DRAWINGS

In order that preferred embodiments of the invention may be readily understood and carried into practical effect, reference is now made to the accompanying drawings, wherein.

DETAILED DESCRIPTION OF THE PREFERRED EMBODIMENTS

Figures 1, 2:
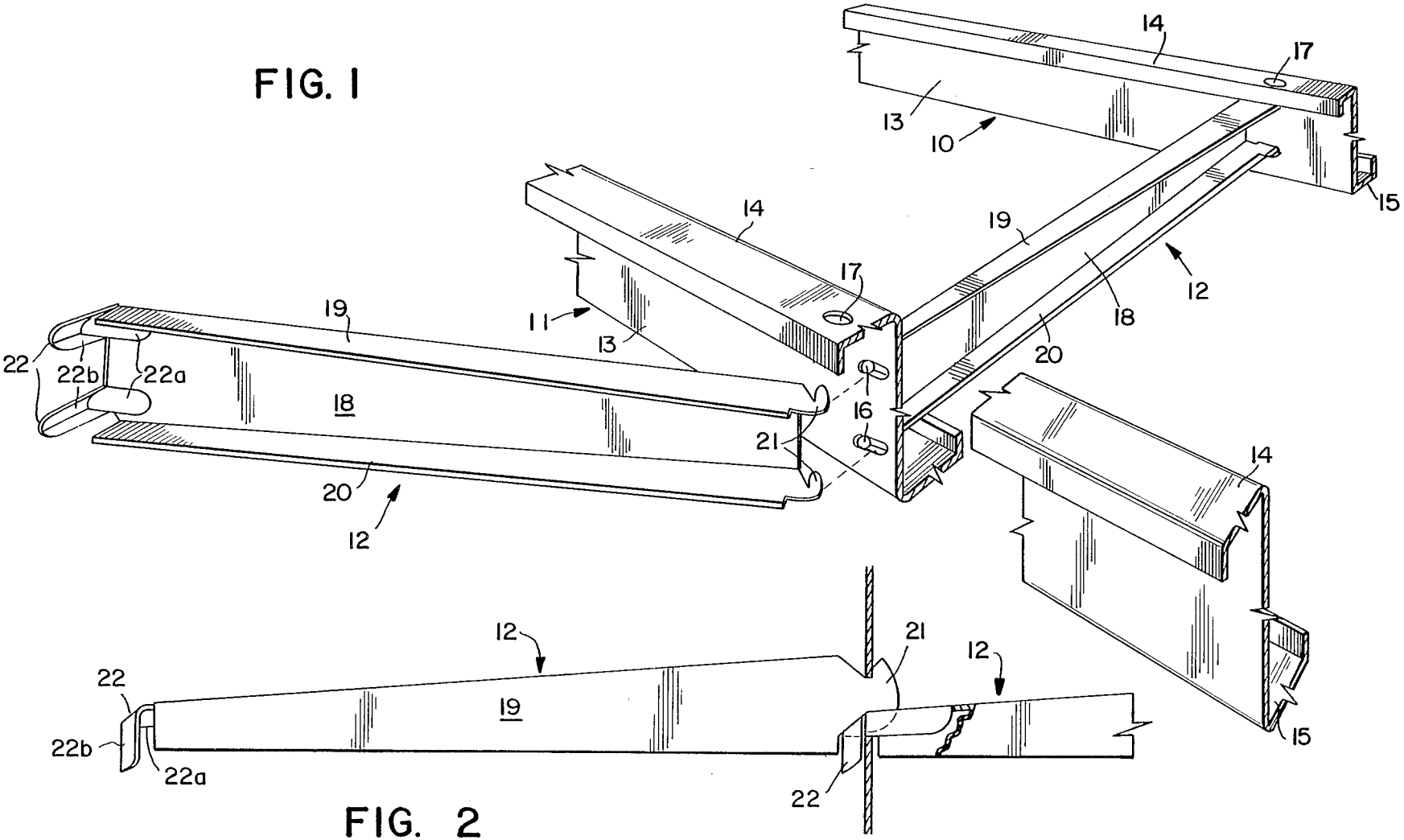
FIG. 1 is a partly broken-away perspective view showing a pair of purlins, and bridging members according to the invention.
FIG. 2 is a partly broken-away plan view showing the connection of two oppositely directed bridging members to a purlin.

In FIGS. 1 and 2 of the drawings, a number of purlins, of which two are shown at 10 and 11, are required to be bridged by bridging members or pieces 12. Each of the purlins is of well-known roll-formed steel type having a web 13 and oppositely directed top and bottom flanges 14 and 15 perpendicular to the web and with their outer edge portions bent downwardly and upwardly respectively. At intervals, pairs of holes 16 are formed in the web 13, one above the other, and holes 17, aligned with these, are formed in the top and bottom flanges 14 and 15.

Each of the bridging pieces 12 is a channel member having a web 18 and top and bottom flanges 19 and 20 perpendicular to the web. The web diminishes in depth from one end to the other. As it will usually be most convenient for the bridging pieces to be shaped from uniform-width sections of galvanized sheet steel, the top and bottom flanges 19 and 20 in the embodiment illustrated also taper, in opposite direction to the taper of the web.

At the less deep end of the bridging piece the top and bottom flanges 19 and 20 are extended for some distance beyond the end of the web 18, and these extended part are shaped to form a pair of similar cam hooks 21 of such shape and disposition that if this end of the bridging piece 12 is brought to the purlin web 13 at an acute angle, as shown in relation to purlin 11 in FIG. 1, the two hooks 21 can pass easily through a pair of the holes 16 in the purlin web; and if the bridging piece is then swung to bring it perpendicular to the purlin web, the hooks 21 will be positioned to prevent the bridging piece from being withdrawn, as shown in FIG. 2.

At the other or deeper end of the bridging piece 12, a pair of lugs 22 extend from the top and bottom of the bridging piece web 18 and, a short distance beyond the end of the web, are bent through right angles in the direction opposite to or away from the top and bottom flanges 19 and 20. The lugs 22 are shaped to ridge-and-valley form, a part **22*a* pressed from the web 18 being deformed to a valley, or concavity viewed from outside the channel, the bent-over part 22*b* being shaped to a ridge, or convexity, into which the valley leads at the bend. This imparts considerable strength to the lugs, the parts 22*b* of which are of a width close to the depth of the holes 16** in the purlin web. Each of these holes in a conventional purlin are of somewhat greater length than depth, and are semicircular at each end.

To instal a series of bridging pieces 12 to bridge a number of purlins 10, 11, a first bridging piece 12 has the hooks 21 at its less deep end inserted through a pair of the holes 16 in the first purlin 10. The bridging piece is then swung to bring it perpendicular to the purlin 10, and in so doing, the lugs 22 pass through the holes 16 in the second purlin 11 and engage firmly against the purlin web 13. The second bridging piece 12 has its hooks 21 engaged in the holes 16 in which the lugs 22 of the first bridging piece are already engaged. The hooks 21 engage behind, and within the hollows of, the ridge portions **22*b* of the lugs 22; and also are brought firmly against the ends of the holes 16 opposite the portions 22*b* of the lugs. The ridged lug portions 22*b* being of about the same height as the holes 16, and the lug parts 22*b* and the engaging hook 21 bearing firmly against the ends of the holes 16**, the connections of the bridging pieces and the purlin is very firm and secure and will resist any tendency of the purlin to twist. In this manner all the purlins of the series are bridged.

It will be seen, then, that the bridging pieces may be quickly and easily installed without the use of any tools or supplementary attachment devices, and as the bridging pieces are of simple and economical manufacture, the bridging of the purlins may be effected with considerable saving of cost, time and labour. Because of the tapered configuration of the bridging pieces, a number of them may be readily nested one into the other, to very compact form for storage and transport.

Figure 3:
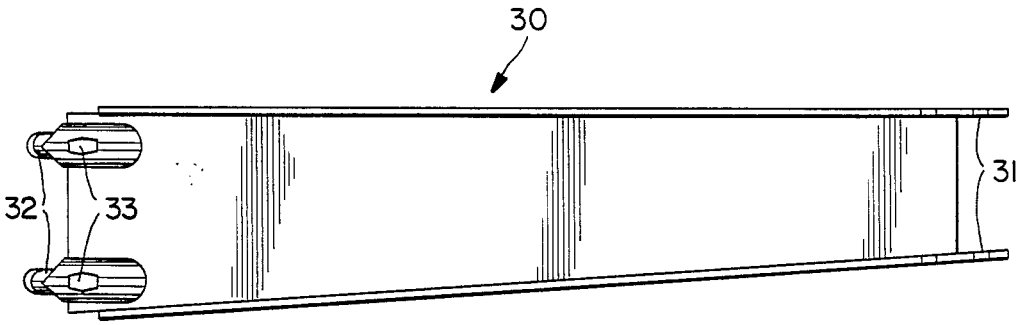
FIG. 3 is a side elevational view of a purlin bridging member according to an alternative embodiment of the invention.
Figure 4:
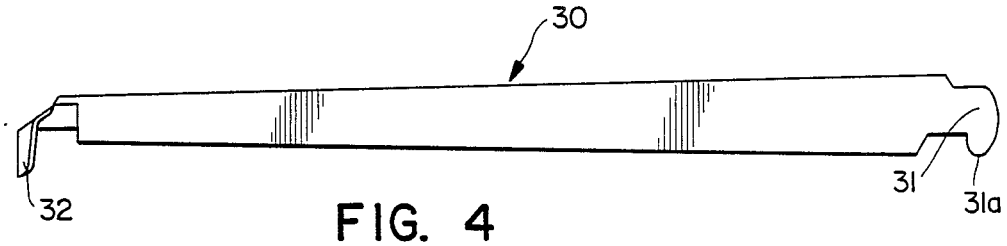
FIG. 4 is a plan view of the member shown in FIG. 3.
Figure 5:
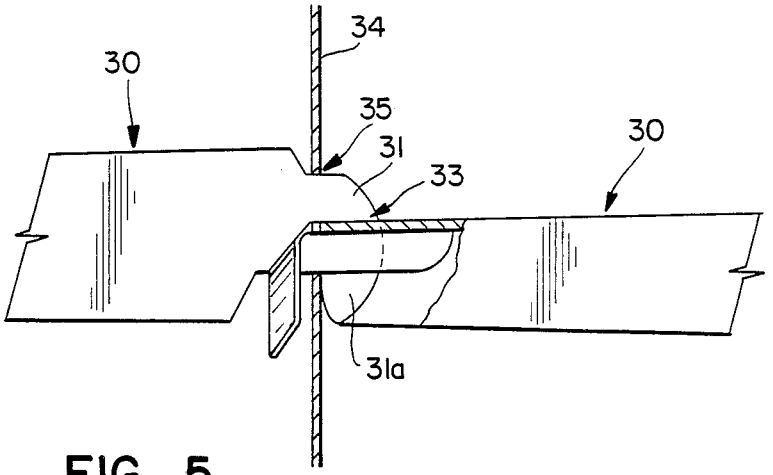
FIG. 5 is a partly broken away view of the interconnection of bridging as shown in FIGS. 3 and 4 to a purlin.

In the embodiments shown in FIGS. 3, 4 and 5, the bridging piece 30 is again of tapered channel form. In this modification, however, the hooks 31 are of somewhat different form, their pointed extremities 31*a* being directed oppositely to those in the previous embodiment; and the lugs 32 are formed with slots 33 lying centrally along their valleys.

In engaging two of the bridging pieces 30 with a purlin 34, the lugs 32 of the first bridging piece are passed through the holes 35 of the purlin. The hooks 31 of the other bridging piece are also inserted through the holes 35 and also have their pointed extremities 31*a* engaged in the slots 33 in the lugs 32 of the first bridging piece. In each of the holes 35 of the purlin, a lug 32 of one bridging piece and a hook 31 of the other bear firmly against the ends of the hole 35. At the same time, the purlin web is held firmly between the hooks 31 and the lugs 32. When the roof structure has been completed, the bridging piece of each series are firmly locked one to the next, producing a very strong and firm construction even though the bridging pieces may be made of light gauge, and therefore inexpensive, sheet material.

I claim:

1. Purlin bridging of the type comprising a series of bridging members each at its ends engaging in holes in a sheet metal purlin, wherein each bridging member includes:

a channel, with a web between a pair of flanges, lugs extending from and substantially perpendicular to the web for engagement in the purlin holes, hooks projecting from the flanges of the channel for engagement in the purlin holes, locking the lugs of the next succeeding bridging member against disengagement from the purlin holes.

2. Purlin bridging according to claim 1 wherein:

the lugs are of ridge-and-valley form, the ridge portion being substantially perpendicular to the web, the valley portion being formed from the channel web and extending into the hollow behind the ridge portion.

3. Purlin bridging according to claim 1 wherein:

the hooks are of cam form such that, when the bridging member is swung to engage the hooks in the purlin holes, the hooks are forced towards one end of the purlin holes, the lugs of the next succeeding bridging member are forced towards the other end of the purlin holes.

4. Purlin bridging according to claim 1 wherein:

the lugs are formed with slots to accept the leading end of the hooks of the next succeding bridging member.

5. Purlin bridging according to claim 1 wherein:

the channel is web-tapered, diminishing in depth from the end formed with the hooks to the end formed with the lugs.

* * * * *